US009058793B1

(12) United States Patent
Yang

(10) Patent No.: US 9,058,793 B1
(45) Date of Patent: Jun. 16, 2015

(54) KEY MECHANISM FOR A SAXOPHONE

(71) Applicant: YANG SHERNG ENTERPRISE CO., LTD., Nantou County (TW)

(72) Inventor: Fu-Liang Yang, Taichung (TW)

(73) Assignee: Yang Sherng Enterprise Co., Ltd., Caotun Township (TW)

( * ) Notice: Subject to any disclaimer, the term of this patent is extended or adjusted under 35 U.S.C. 154(b) by 0 days.

(21) Appl. No.: 14/563,588

(22) Filed: Dec. 8, 2014

(30) Foreign Application Priority Data

Dec. 11, 2013 (TW) ..... 102223323 U

(51) Int. Cl.

| | |
|---|---|
| ***G10D 7/08*** | (2006.01) |
| ***G10D 7/00*** | (2006.01) |
| ***G10D 9/00*** | (2006.01) |
| ***G10D 9/04*** | (2006.01) |

(52) U.S. Cl.
CPC ..... *G10D 7/08* (2013.01); *G10D 9/043* (2013.01); *G10D 9/04* (2013.01); *G10D 9/00* (2013.01); *G10D 7/00* (2013.01)

(58) Field of Classification Search
CPC ..... G10D 7/08; G10D 7/00; G10D 9/00; G10D 9/04; G10D 9/043
USPC ..... 84/385 R, 385 P, 380 R, 453
See application file for complete search history.

(56) References Cited

U.S. PATENT DOCUMENTS

| | | | | | |
|---|---|---|---|---|---|
| 1,585,295 | A | * | 5/1926 | Loomis | 84/385 R |
| 1,662,195 | A | * | 3/1928 | Loomis | 84/385 R |
| 2,033,772 | A | * | 3/1936 | Loomis | 84/382 |
| 2,163,352 | A | * | 6/1939 | Powell | 84/385 R |
| 2,180,118 | A | * | 11/1939 | Loney | 84/385 R |
| 2,775,915 | A | * | 1/1957 | De Ford | 84/380 R |
| 3,064,516 | A | * | 11/1962 | Hampel | 84/382 |
| 3,145,610 | A | * | 8/1964 | Anderson et al. | 84/380 R |
| 3,191,482 | A | * | 6/1965 | Leblanc | 84/382 |
| 3,865,005 | A | * | 2/1975 | Carree | 84/380 R |
| 4,328,734 | A | * | 5/1982 | Gebler | 84/380 R |
| 4,453,445 | A | * | 6/1984 | Todd | 84/385 R |
| 4,516,463 | A | * | 5/1985 | Satoh | 84/385 R |
| 5,237,902 | A | * | 8/1993 | Hamanaga | 84/386 |
| 5,900,562 | A | * | 5/1999 | Smeding | 84/385 P |
| 5,990,398 | A | * | 11/1999 | Nonaka | 84/385 R |
| 5,990,399 | A | * | 11/1999 | Runyon | 84/385 R |
| 6,225,541 | B1 | * | 5/2001 | Kodera et al. | 84/385 P |
| 6,265,649 | B1 | * | 7/2001 | Smeding | 84/385 R |
| 6,559,366 | B1 | * | 5/2003 | Takahashi | 84/380 R |

(Continued)

*Primary Examiner* — Elvin G Enad
*Assistant Examiner* — Christina Schreiber
(74) *Attorney, Agent, or Firm* — Wang Law Firm, Inc.; Li K. Wang; Stephen Hsu

(57) ABSTRACT

A key mechanism for a saxophone includes a lever, a sound-hole cover, an adjustment member, and a touch piece. The lever includes a connecting portion in which being formed a rotation-stop hole, and a slot in communication with and perpendicular to the rotation-stop hole. The adjustment member is rotatably and partially disposed in the slot and has a threaded hole in communication with the rotation-stop hole. The touch piece includes a press portion, a rotation-stop portion and a screw. The rotation-stop portion is engaged in the rotation-shaped hole, and the screw is screwed in the threaded hole of the adjustment member, so that rotating the adjustment member causes the screw to linearly move with respect to the adjustment member. Therefore, the height position of touch piece of the saxophone can be adjusted without using any hand tools.

4 Claims, 5 Drawing Sheets

(56) References Cited

U.S. PATENT DOCUMENTS

| | | | | |
|---|---|---|---|---|
| 7,608,768 | B2 * | 10/2009 | Thanyakij | 84/385 R |
| 2006/0283307 | A1 * | 12/2006 | Lin | 84/385 R |
| 2007/0245879 | A1 * | 10/2007 | Hsien | 84/385 R |
| 2008/0017014 | A1 * | 1/2008 | Suzuki | 84/385 R |
| 2008/0202314 | A1 * | 8/2008 | Thanyakij | 84/385 R |
| 2012/0167744 | A1 * | 7/2012 | Ponzol et al. | 84/385 P |

* cited by examiner

KEY MECHANISM FOR A SAXOPHONE

BACKGROUND OF THE INVENTION

1. Field of the Invention

The present invention relates to a saxophone, and more particularly to a key mechanism for a saxophone.

2. Description of the Prior Art

A saxophone essentially comprises a plurality of keys disposed on a tubular instrument body, and the tubular body instrument body is formed with a plurality of sound holes. Each of the keys 10, as shown in FIGS. 1 and 2, comprises a lever 11 pivoted to the instrument body, and a touch piece 12 and a sound-hole cover 13 at two ends of the lever 11. A user can play music by pressing different touch pieces 12, which consequently makes the sound-hole covers 13 close or open corresponding sound holes.

However, different players have different finger sizes, and the habits of pressing the keys are also different from player to player. Therefore, the saxophone won't be able to accommodate different players, if the touch pieces 12 cannot be adjusted. To solve this problem, the keys 10 are designed to be adjustable, wherein the touch piece 12 of each of the keys 10 is adjustably disposed in a slot 111 of the lever 11 by a slide block 121 and can be fixed at a desired position in the slot 111 by a fixing member 14. When the position of the touch piece 12 needs to be adjusted, a hand tool must be used to tighten and loose the fixing member. However, normally, a player won't take a hand tool with him or her all the time, which makes it the adjustment impossible or at least inconvenient. Besides, the height position of the touch piece 12 is restricted by the upmost holes of the slide block 121, and therefore cannot be freely adjusted.

The present invention has arisen to mitigate and/or obviate the afore-described disadvantages.

SUMMARY OF THE INVENTION

The primary objective of the present invention is to provide a key mechanism for a saxophone, wherein the height position of touch piece of the saxophone can be easily adjusted without using any hand tools.

To achieve the above objective, the key mechanism for a saxophone in accordance with the present invention comprises: a lever, a sound-hole cover, an adjustment member, and a touch piece.

The lever is pivotally disposed on a tubular body of the saxophone, at one end of the lever is provided a connecting portion, and in the connecting portion is formed a non-circular rotation-stop hole extending in a first direction, and a slot in communication with the rotation-stop hole and extending in a second direction perpendicular to the first direction.

The sound-hole cover is disposed at another end of the lever.

The adjustment member is in the form of a nut with a threaded hole and rotatably disposed in the slot of the connecting portion of the lever, in a manner that the adjustment member partially protrudes out of the slot, and the threaded hole is in communication with the rotation-stop hole.

The touch piece is provided with a press portion, a rotation-stop portion and a screw. The rotation-stop portion is a non-circular column formed to fit the shape of the rotation-stop hole, the touch piece is inserted in the rotation-stop hole of the connecting portion, in a manner that the rotation-stop portion is engaged in the rotation-shaped hole, and the screw is screwed in the threaded hole of the adjustment member, rotating the adjustment member causes the screw to linearly move with respect to the adjustment member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
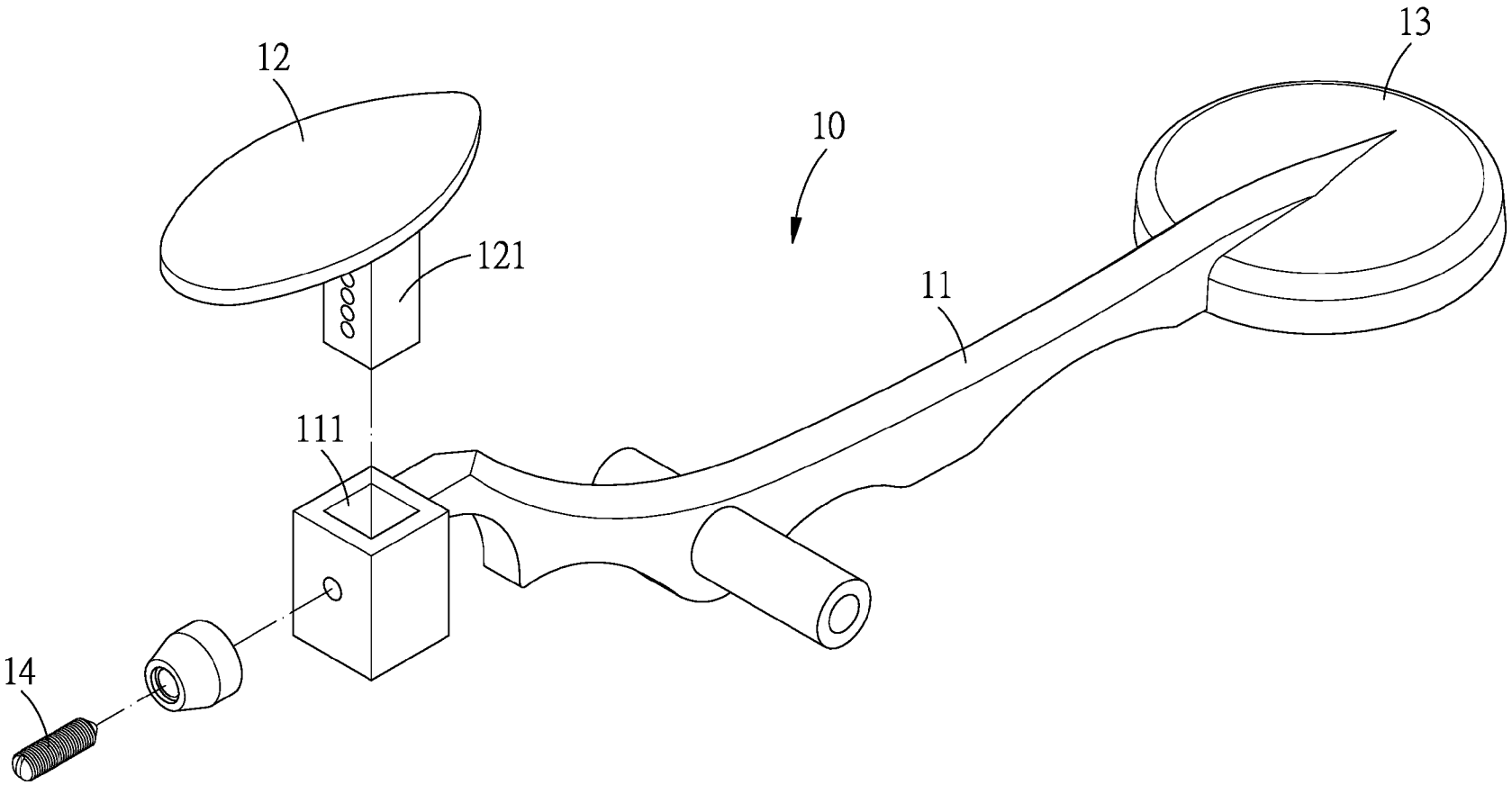
FIG.1 PRIOR ART
FIG. 1 is an exploded view of a conventional key mechanism for a saxophone.
Figure 2:
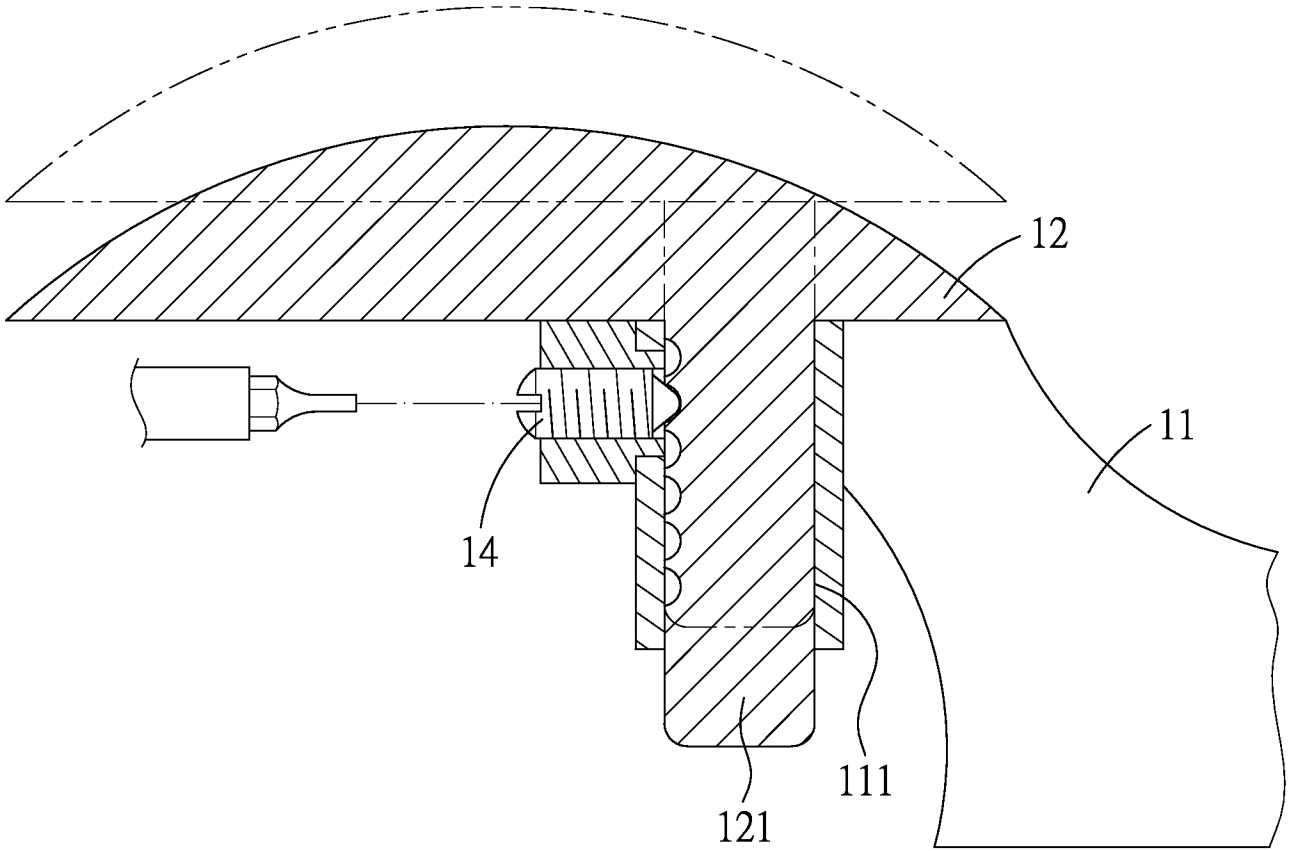
FIG.2 PRIOR ART
FIG. 2 is a cross section view showing how to adjust the conventional key of the saxophone.
Figure 3:
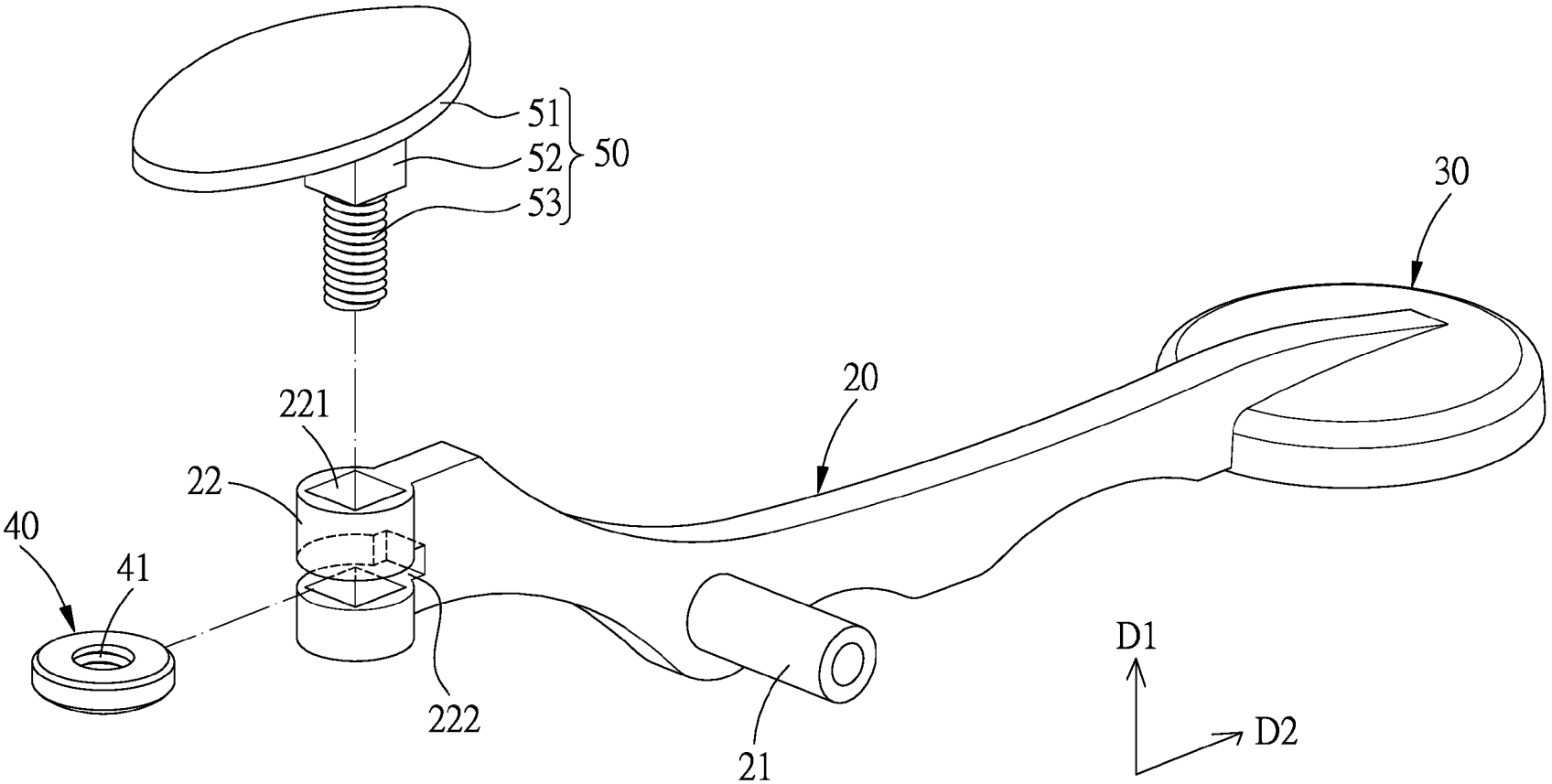
FIG. 3 is an exploded view of a key mechanism for a saxophone in accordance with the present invention.
Figure 4:
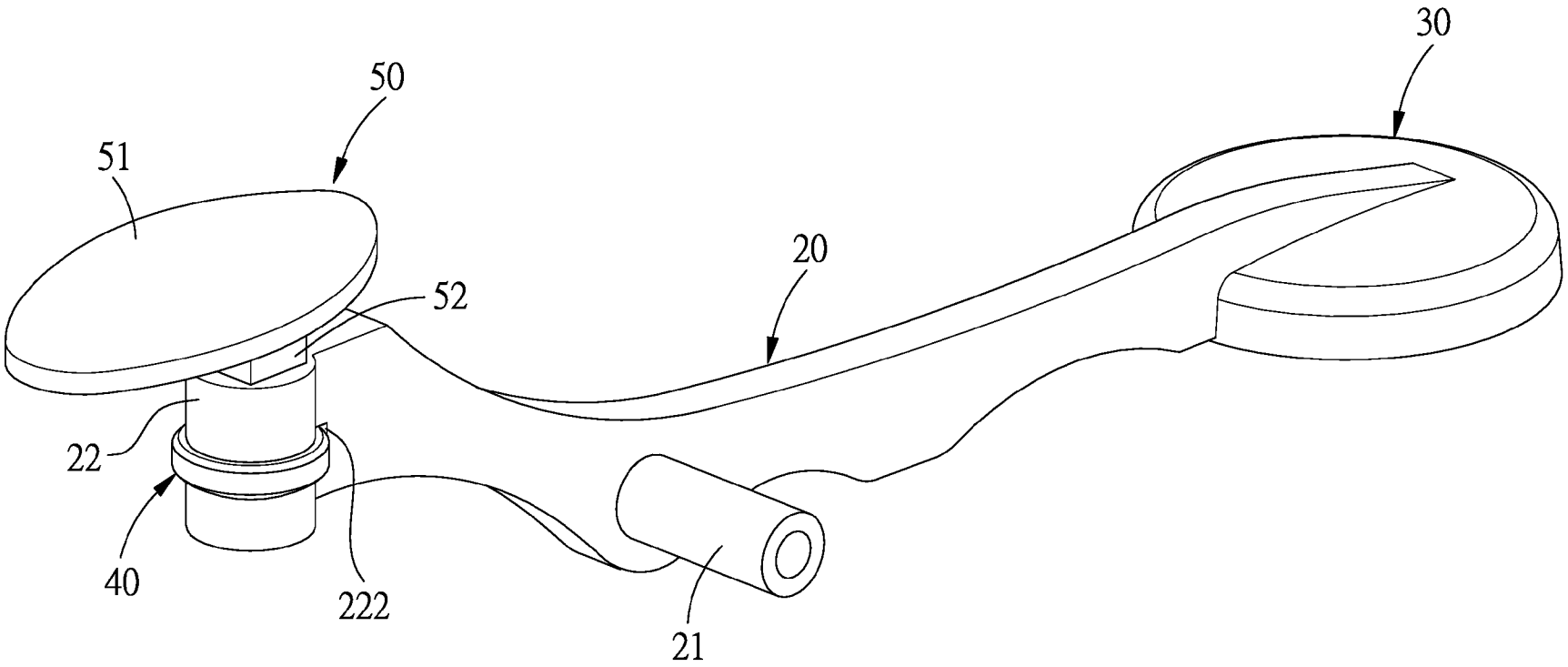
FIG. 4 is an assembly view of the key mechanism for the saxophone in accordance with the present invention.
Figure 5:
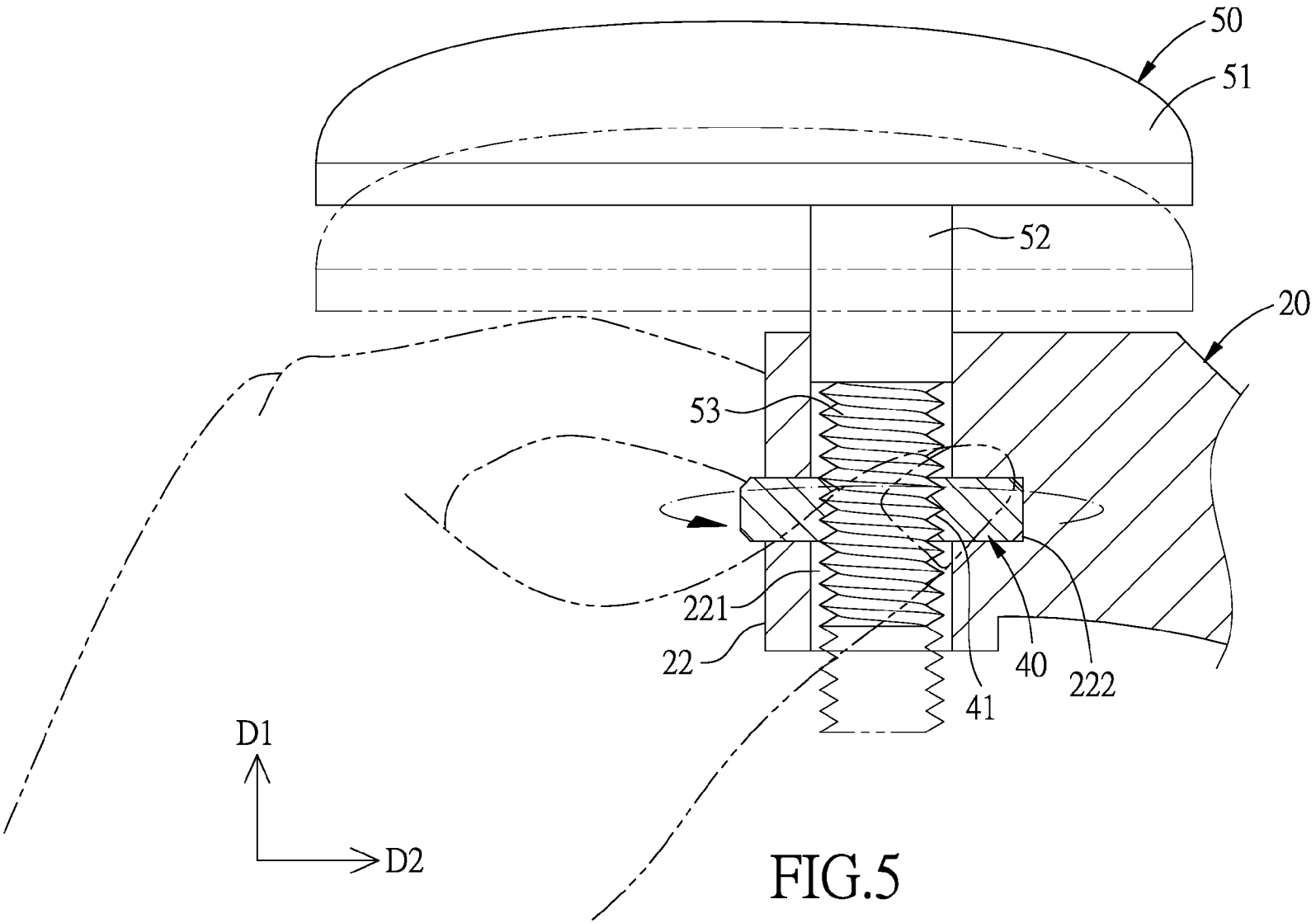
FIG. 5 is a cross sectional view showing how to adjust the key mechanism for the saxophone in accordance with the present invention.

Referring to FIGS. 3-5, a key mechanism for a saxophone in accordance with the present invention comprises: a lever 20, a sound-hole cover 30, an adjustment member 40, and a touch piece 50.

The lever 20 is pivotally disposed on a tubular body of the saxophone by a pivot shaft 21 located between two ends of the lever 20. At one end of the lever 20 is provided a connecting portion 22, and in the connecting portion 22 is formed a non-circular rotation-stop hole 221 extending in a first direction D1. In this embodiment, the rotation-stop hole 221 is square-shaped, and in the connecting portion 22 is further formed a slot 222 in communication with the rotation-stop hole 221 and extending in a second direction D2 perpendicular to the first direction D1.

The sound-hole cover 30 is disposed at another end of the lever 20 and can either be integral with the lever 20 or removably attached thereto. The sound-hole cover 30 is aligned to a corresponding sound hole of the saxophone.

The adjustment member 40 is a nut with a threaded hole 41 and rotatably disposed in the slot 222 of the connecting portion 22 of the lever 20, in such a manner that the adjustment member 40 partially protrudes out of the slot 222, and the threaded hole 41 is in communication with the rotation-stop hole 221.

The touch piece 50 is sequentially provided with a press portion 51, a rotation-stop portion 52 and a screw 53. The rotation-stop portion 52 is a non-circular column formed to fit the shape of the rotation-stop hole 221. In this embodiment, the rotation-stop portion 52 is a square column. The touch piece 50 is inserted in the rotation-stop hole 221 of the connecting portion 22, in such a manner that the rotation-stop portion 52 is engaged in the rotation-shaped hole 221, and the screw 53 is screwed in the threaded hole 41 of the adjustment member 40, so that rotating the adjustment member 40 can make the screw 53 linearly move with respect to the adjustment member 40.

The lever 20 is pivotally disposed on the saxophone by the pivot shaft 21, pressing the press portion 51 of the touch piece 50 can make the lever 20 pivot with respect to the saxophone, and the pivot motion of the lever 20 then makes the sound-hole cover 30 open or close the corresponding sound hole of the saxophone, thus producing sound.

When the height position of the touch piece 50 needs to be adjusted, the user only has rotate the adjustment member 40 with respect to the screw 53, as shown in FIG. 5. Since the rotation-stop portion 52 is engaged with the rotation-stop hole 221 of the lever 20 to stop the touch piece 50 from rotating, the rotation of the adjustment member 40 will be converted into linear motion of the touch piece 50 in the first direction D1. Besides, rotating the adjustment member 40 can adjust the touch piece 50 to a predetermined height, then stop rotating, the touch piece 50 will be kept at the height after adjustment, unlike the conventional key mechanism for a saxophone where the positions of the holes must be aligned during adjustment. By such arrangements, the height position of the touch piece 50 is adjustable in a quick and smoothly continuous manner to accommodate different users. It is to be noted that the rotation-stop hole 221 and the rotation-stop portion 52 can but not limited to be square-shaped, for example, they can also be elliptical-shaped.

It is understood from the above description that the touch piece 50 of the saxophone in accordance with the present invention can be easily adjusted without any hand tools.

While we have shown and described various embodiments in accordance with the present invention, it is clear to those skilled in the art that further embodiments may be made without departing from the scope of the present invention.

What is claimed is:

1. A key mechanism for a saxophone comprising:

a lever pivotally disposed on a tubular body of the saxophone, at one end of the lever being provided a connecting portion, in the connecting portion being formed a non-circular rotation-stop hole extending in a first direction, and a slot in communication with the rotation-stop hole and extending in a second direction perpendicular to the first direction;

a sound-hole cover disposed at another end of the lever;

an adjustment member in the form of a nut with a threaded hole and rotatably disposed in the slot of the connecting portion of the lever, in a manner that the adjustment member partially protrudes out of the slot, and the threaded hole is in communication with the rotation-stop hole; and a touch piece being provided with a press portion, a rotation-stop portion and a screw, the rotation-stop portion being a non-circular column formed to fit the shape of the rotation-stop hole, the touch piece being inserted in the rotation-stop hole of the connecting portion, in a manner that the rotation-stop portion is engaged in the rotation-shaped hole, and the screw is screwed in the threaded hole of the adjustment member, rotating the adjustment member causes the screw to linearly move with respect to the adjustment member.

2. The key mechanism for the saxophone as claimed in claim 1, wherein the lever is pivotally disposed on the saxophone by a pivot shaft located between two ends of the lever.

3. The key mechanism for the saxophone as claimed in claim 1, wherein the rotation-stop hole is a square hole, and the rotation-stop portion is a square column.

4. The key mechanism for the saxophone as claimed in claim 1, wherein the rotation-stop hole is an elliptical hole, and the rotation-stop portion is an elliptical column.

* * * * *